US006082078A

United States Patent [19]

Weber et al.

[11] Patent Number: 6,082,078

[45] Date of Patent: Jul. 4, 2000

[54] NUTRUNNER DRIVER FOR A PLASTIC BOTTLE CAPPING MACHINE

[75] Inventors: Lawrence H. Weber, Ypsilanti, Mich.; James M. Sheely, Toledo, Ohio; J. Robert Corson, Saline, Mich.

[73] Assignee: R & B Machine Tool Company, Saline, Mich.

[21] Appl. No.: 09/253,630

[22] Filed: Feb. 19, 1999

[51] Int. Cl.[7] ..... B65B 7/28

[52] U.S. Cl. ..... 53/403; 53/490; 53/88; 53/97; 53/101; 53/331.5; 29/421.1; 29/456; 29/773; 29/801

[58] Field of Search ..... 53/403, 432, 468, 53/490, 88, 97, 101, 317, 331.5, 510; 29/421.1, 456, 773, 776, 801

[56] References Cited

U.S. PATENT DOCUMENTS

| | | | |
|---|---|---|---|
| 2,614,739 | 10/1952 | Pasotti | 53/101 |
| 2,930,170 | 3/1960 | Holsman | 53/468 |
| 3,299,603 | 1/1967 | Shaw | 53/468 |
| 3,577,696 | 5/1971 | Bock | 53/97 |
| 4,106,263 | 8/1978 | Conrad | 53/97 |
| 4,136,502 | 1/1979 | Shore . | |
| 4,210,852 | 7/1980 | Gustavson . | |
| 4,243,448 | 1/1981 | Fagniart et al. . | |
| 4,651,497 | 3/1987 | Grimsley | 53/101 |
| 5,259,912 | 11/1993 | Cline . | |
| 5,319,984 | 6/1994 | Humphries et al. . | |
| 5,322,094 | 6/1994 | Janesko . | |
| 5,408,801 | 4/1995 | Molinaro . | |
| 5,415,050 | 5/1995 | Trendel et al. . | |
| 5,555,705 | 9/1996 | Balcombe . | |
| 5,621,960 | 4/1997 | Kaminski . | |

*Primary Examiner*—John Sipos
*Attorney, Agent, or Firm*—Reising, Ethington, Barnes, Kisselle, Learman & McCulloch, P.C.

[57] ABSTRACT

A method is provided for joining a flexible container to a threaded closure. According to the method, a flexible container is inflated with pressurized gas before applying torque to the container. A base of the flexible container is engaged in a container receptacle of a capping apparatus, then the capping apparatus is operated to cause a neck of the flexible container to engage a threaded opening in the closure. The bottle is then inflated and the capping apparatus is operated to thread the neck of the flexible container into the opening in the closure by causing relative rotation between the flexible container and the closure. The pressurized gas stiffens the flexible container and prevents it from buckling or twisting under torque loads applied to screw the container into the closure.

19 Claims, 3 Drawing Sheets

Figure 1:
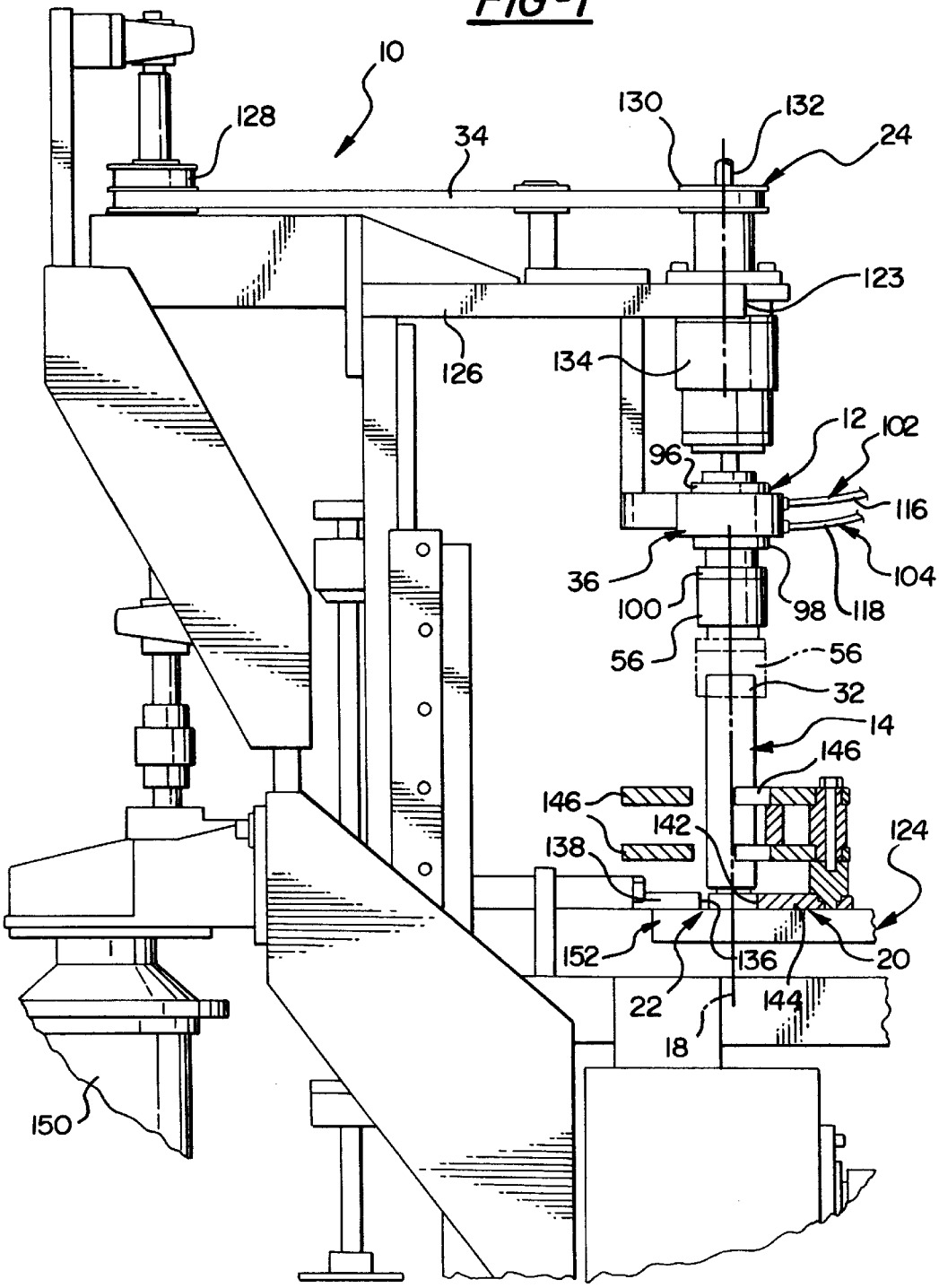

24
12
10
96
94
74
102
38
120
38
70
104
106
112
114
106
122
78
116
122
72
120
36
108
68
80
114
122
84
110
108
88
62
66
118
122
112
82
120
38
76
106
104
38
90
42,54
98
26
60
100
52
86
92
48
58
44
32
40,50
46
64
56
154
28
14

152
30
140
16
20
142
144
20
22
136
138
18

24
12
10
94
96
68
38
70
122
102
38
104
120
106
82
106
112
122
84
114
36
74
116
122
120
106
108
66
78
114
118
108
110
112
72
80
62
120
104
122
38
106
38
86
88
26
90
40,50
98
76
100
60
52
32
92
44
58
42,54
64
46
56

14
28
154
152
16
140
30
142
144
20
20
22
138
18
136

NUTRUNNER DRIVER FOR A PLASTIC BOTTLE CAPPING MACHINE

TECHNICAL FIELD OF THE INVENTION

This invention relates generally to a method and apparatus for applying a threaded closure to the threaded neck of a flexible container and, more particularly, to such a method and apparatus configured to accomplish this before filling the tube with the product it is intended to dispense.

INVENTION BACKGROUND

The prior art includes a number of different methods and apparatus for manufacturing flexible containers that are subsequently used to dispense pasty or viscous products such as skin lotions, toothpaste and shampoo. For example, U.S. Pat. No. 5,621,960; issued Apr. 22, 1998 to Kaminsiki; discloses a method and apparatus for applying a threaded closure to an inverted tube-type flexible container. The apparatus includes a rotatably mounted, belt-driven chuck mounted on an outer end of a radially extending arm of a rotatable indexed turret. The chuck includes axially downward extending lugs configured to engage recesses in the inverted base of a flexible tube and enabling the chuck to rotate the tube. The resulting tube rotation drives a threaded neck of the tube into an inverted threaded cap. To secure the cap against rotational movement, the cap is clamped between a semi-circular star wheel recess and an opposing semi-circular recess in a cylinder-driven, reciprocally mounted clamp. The star wheel is coaxially mounted on and rotatably indexes with the turret. Following this capping operation, the inverted base of the flexible tube is severed to provide an opening for a subsequent filling operation. Unfortunately, the amount of torque that can be applied to screw a flexible bottle into a threaded cap in this way is limited by the rigidity of the walls of the flexible bottle. Excessive torque will cause the bottle to twist and/or crush. This torque limit consequently limits both the speed at which the bottle can be screwed into the cap and the tightness of the cap on the bottle. In addition, even if a torque limiter is adjusted to apply an optimum amount of torque for a given wall thickness and/or rigidity, variations in wall thickness can result in an unacceptably high scrap rate.

Some machines that handle flexible containers use gas inflation to temporarily rigidify the containers. In some cases, such machines use gas inflation to enable the flexible containers to withstand forces typically applied during various labeling operations. For example, U.S. Pat. No. 5,259,912; issued Nov. 9, 1993 to Cline; discloses an apparatus for continuous in-line labeling of flexible walled bottles. The apparatus includes an air pulse station that directs pressurizing gas into the bottles. The gas inflates the bottles through uncapped mouths of the bottles and allows the bottles to resist compression as conveyor members compressively hold them and labeling machinery applies labels to the bottles. Bottle filling and capping occurs after inflation.

In at least one other flexible tube handling machine, gas inflation is used to form and hold the shape of flexible containers until the containers can be sealed. U.S. Pat. No. 4,136,502; issued Jan. 30, 1979 to Shore; discloses an inflater sealer machine that clamps the open upper portion of a flexible container, fills the container with a quantity of gas, then seals the upper portion closed. The gas pressure inflates the container into its desired shape then maintains that shape until the sealer machine seals it closed.

What is needed is a method for driving the threaded neck of a flexible container into a threaded closure without crushing or twisting the container. What is also needed is a closure-applying apparatus configured to accomplish this.

INVENTION SUMMARY

In accordance with this invention, a method is provided for joining a flexible container to a threaded closure that includes the inflating of the flexible container with pressurized gas before applying torque to the container. The method also includes the steps of providing a flexible container having a base and a threaded neck, providing a closure configured to sealingly engage the threaded neck, providing a capping apparatus including a container receptacle configured to engage the base of the flexible container, engaging the base of the flexible container with the container receptacle, and operating the capping apparatus to cause the neck of the flexible container to engage the threaded opening in the closure. The bottle is then inflated and the capping apparatus is operated to thread the neck of the flexible container into the opening in the closure by rotating either the flexible container or the closure. The pressurized gas stiffens the flexible container and prevents it from buckling or twisting under torque loads applied to screw the container into the closure.

According to another aspect of the inventive method, a rotationally mounted container receptacle is provided. In addition, the closure is secured against rotation and the flexible container is rotated when the capping apparatus is operated to thread the neck of the flexible container into the opening in the closure.

According to another aspect of the inventive method, the base of the flexible container is inserted into a drive sleeve of the container receptacle.

According to another aspect of the inventive method, a container detent is formed in the base end of the container and a container receptacle detent is formed in the drive sleeve of the container receptacle. The capping apparatus is operated to cause the container receptacle detent to engage the container detent.

According to another aspect of the inventive method, a hollow needle is provided in the container receptacle, fluid communication is provided between the source of pressurized gas and the needle and the capping apparatus is operated to place the base of the flexible container within the drive sleeve. This causes the needle to extend into the drive sleeve and to pierce the base of the flexible container. Pressurized gas is then injected into the flexible container through the hollow needle causing a sidewall of the container to move outward against the drive sleeve.

According to another aspect of the inventive method, a piston is provided in a cylinder within the container receptacle with the needle being supported in and extending from the piston. In addition, the piston is caused to move toward the base of the container by providing pressurized gas in the cylinder on a side of the piston opposite the base.

According to another aspect of the inventive method, the container receptacle is oriented to receive the base of the container vertically upward into the receptacle with the container neck extending downward. The closure is also provided in an inverted orientation and is disposed below the downwardly extending neck of the flexible container.

According to another aspect of the inventive method, a torque limiter is provided and is configured to limit the amount of torque that the apparatus applies to the flexible container while threading the container into the closure.

According to another aspect of the inventive method, a rotatably indexed turret is provided that includes a plurality of rotatably mounted container receptacles spaced around an upper circumference of the turret. The turret includes a plurality of closure receptacles spaced around a lower circumference of the turret. Each closure receptacle is spaced axially below a container receptacle.

In accordance with the invention, a capping apparatus is provided for joining a hollow flexible container and a threaded closure. The apparatus comprises a container receptacle configured to engage a flexible container having a threaded generally cylindrical neck, the neck having a central container neck axis. A closure receptacle is configured to engage a closure in a position adjacent the container neck and coaxially aligned with the container neck axis. A drive is operably connected to at least one of the container receptacle and the closure receptacle. The drive is operable to rotate at least one of the container receptacle and the closure receptacle around the container neck axis to threadedly engage the container neck and closure. A source of pressurized gas is configured to fluidly communicate with an interior of the flexible container. The pressurized gas inflates the flexible container and causes the container to positively engage the container receptacle. Inflation also causes the flexible container to resist deformation under torque loads resulting from threaded engagement of the container neck and closure.

According to another aspect of the invention, the container receptacle is rotationally mounted and the closure receptacle is configured to support a closure against rotation. The drive is operably connected to the container receptacle and is operable to rotate the container receptacle around the container neck axis.

According to another aspect of the invention, the container receptacle includes a container receptacle detent configured to engage a container detent formed in the flexible container. The detents engage each other when the flexible container is seated in the container receptacle.

According to another aspect of the invention, the container receptacle detent comprises a male step notch configured to complement and engage a female step notch formed in a base of the container. The engagement between the male and female step notches allows the container receptacle to positively rotate the container seated within it.

According to another aspect of the invention, the container receptacle includes a generally cylindrical drive sleeve configured to receive the base end of the flexible container. The male step notch is formed into an inner end wall of the drive sleeve. The drive sleeve is shaped to complement the exterior dimensions of the flexible container when the flexible container is at least partially inflated.

According to another aspect of the invention, the container receptacle includes a hollow needle configured to pierce the flexible container. The hollow needle is fluidly communicable with the source of pressurized gas and feeds the gas from the source into the flexible container.

According to another aspect of the invention, the container receptacle includes a piston supported for reciprocal movement in a cylinder disposed adjacent the drive sleeve. The hollow needle is supported in the piston along a central axis of the piston. The needle and piston are movable between a retracted position and a protracted position. The needle protrudes into the drive sleeve in the protracted position.

According to another aspect of the invention, the container receptacle includes two gas channels leading from the source of pressurized gas to the cylinder. An upper one of the gas channels opens into an end of the cylinder opposite the drive sleeve and a lower one of the two gas channels opens into an end the cylinder adjacent the drive sleeve. The source of pressurized gas includes at least one control valve configured to alternately direct pressurized gas through the upper and lower gas channels to drive the piston and needle downward and upward, respectively.

According to another aspect of the invention, the source of pressurized gas is supported in a fixed location remote from the rotatably mounted container receptacle. A generally cylindrical portion of the container receptacle is surrounded by a stationary collar, the cylindrical portion and collar forming a rotary union configured to supply pressurized gas from the source of pressurized gas to the upper and lower gas channels while the container receptacle is rotating within the collar.

According to another aspect of the invention, a plurality of the container receptacles are mounted in spaced-apart disposition around an upper circumference of a rotatably indexed turret. A plurality of closure receptacles is included in spaced-apart disposition around a lower circumference of the turret and is spaced axially from the upper circumference.

According to another aspect of the invention, the lower circumference of the turret is defined by an outer circumferential edge of a star wheel. The closure receptacles comprise a plurality of semi-circular recesses formed into the outer circumferential edge of the star wheel. The closure receptacle further comprises opposing semi-circular recesses in a plurality of reciprocally mounted clamps. The star wheel and clamp recesses are configured to releasably secure closures against rotational movement.

According to another aspect of the invention, the capping apparatus includes a torque limiter connected between the drive and the closure receptacle. The torque limiter allows sufficient torque to tighten the closure but limits torque sufficiently to prevent twisting and buckling of the flexible container as well as over-tightening of the closure.

According to another aspect of the invention, the capping apparatus is configured to join a hollow flexible container in an inverted orientation to a threaded closure supported in an inverted orientation below the flexible container. This allows the containers to be filled through their base ends after the base ends are severed in a subsequent manufacturing step.

BRIEF DRAWING DESCRIPTION

Figure 2:
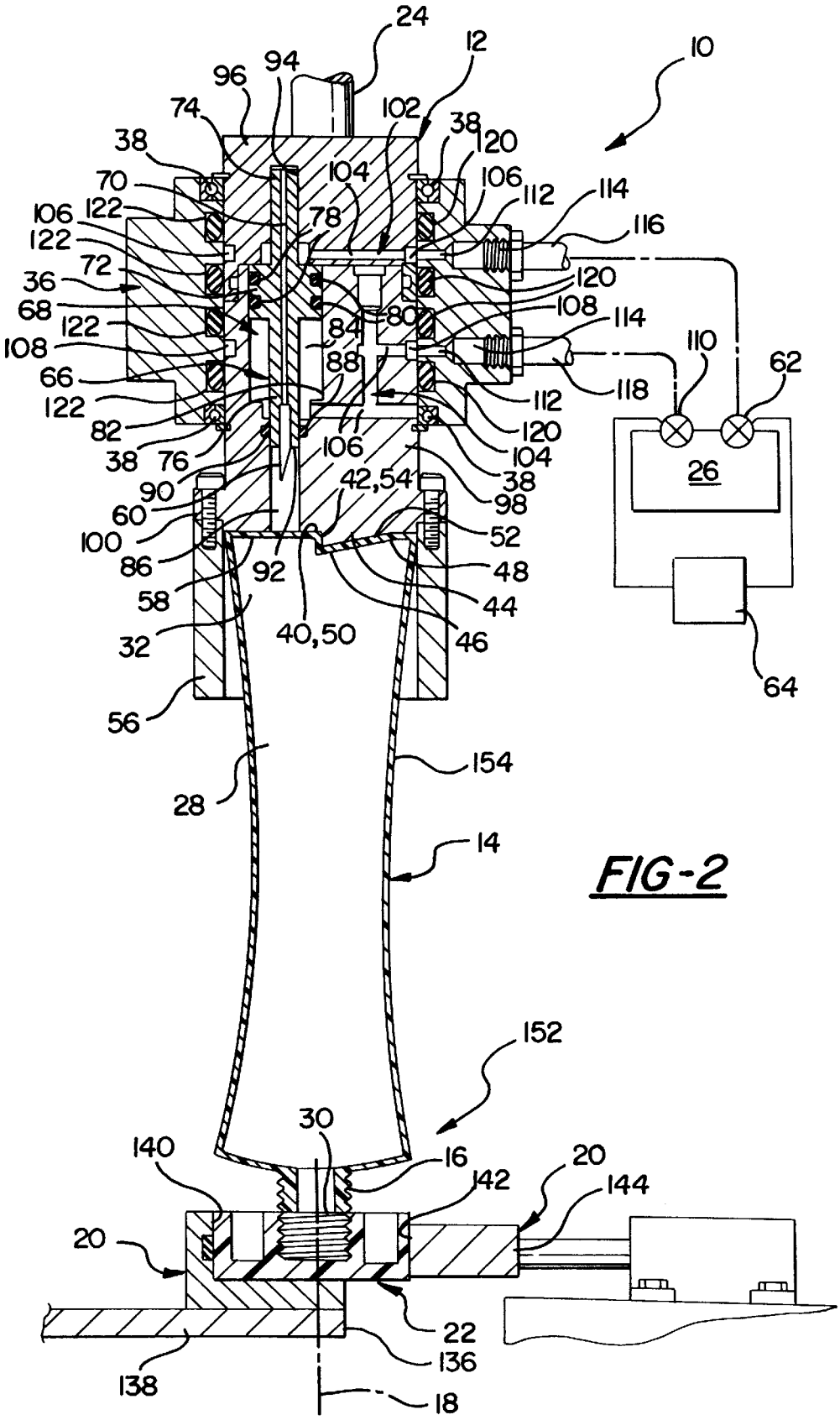
Figure 3:
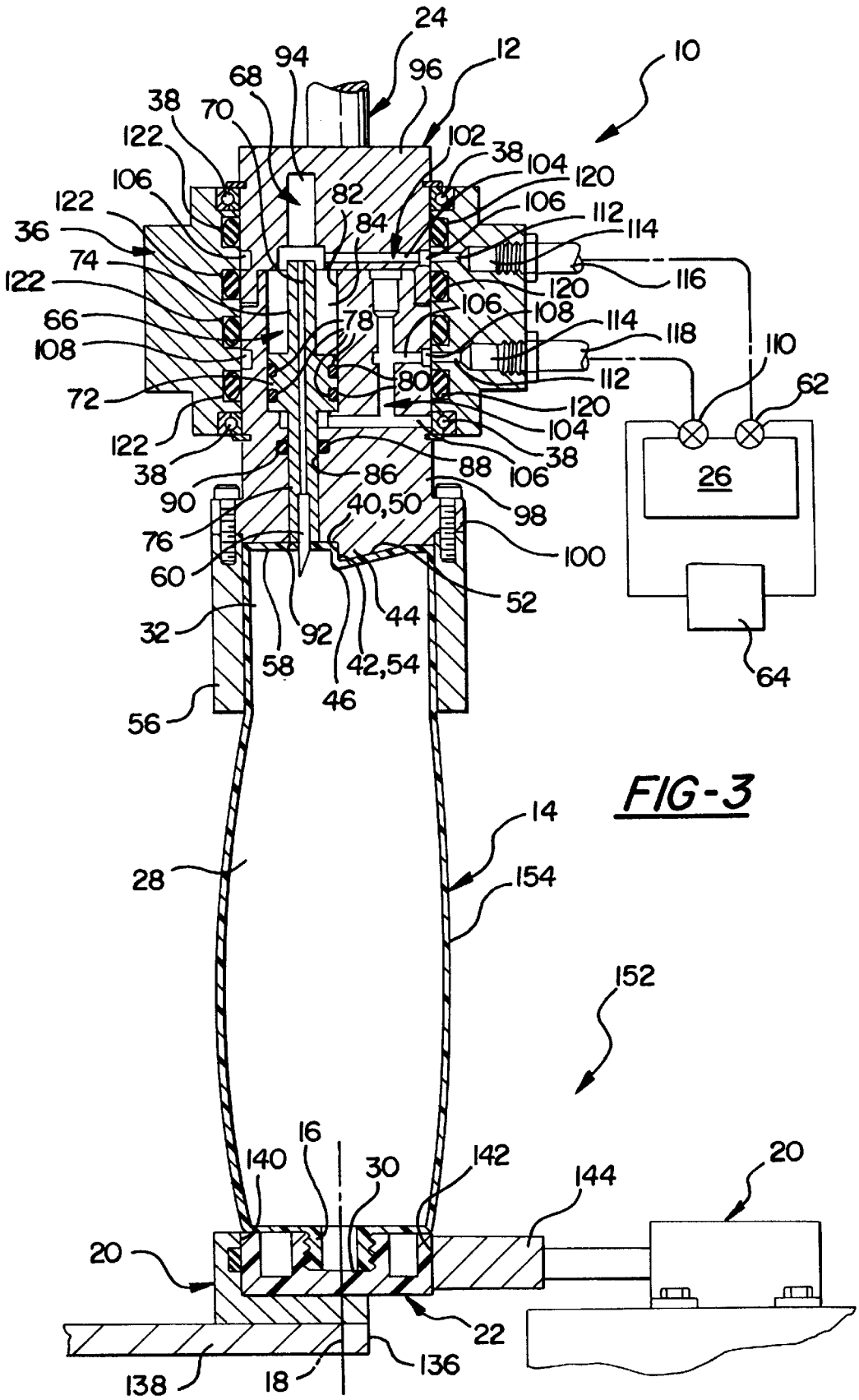

To better understand and appreciate the invention, refer to the following detailed description in connection with the accompanying drawings:

FIG. 1 is a partial cross-sectional front elevational view of a container capping apparatus constructed according to the invention;

FIG. 2 is a cross-sectional front view of a flexible container engaged in a container receptacle constructed according to the invention and a closure engaged in a closure receptacle constructed according to the invention, the flexible container being uninflated; and FIG. 3 is a cross-sectional front view of the container, closure and receptacles of FIG. 2 with the flexible container inflated and threadedly engaged with the closure.

PREFERRED EMBODIMENT DESCRIPTION

A capping apparatus for joining inverted tube-type hollow flexible containers and threaded closures is generally shown at 10 in FIGS. 1–3. The apparatus 10 comprises a pair of nutrunner drivers, i.e., rotationally mounted container receptacles, one of which is generally indicated at 12 in FIGS. 1–3. The two container receptacles 12, or chucks, are mounted together in parallel vertical orientation to engage two inverted flexible containers at a time. A representative one of the flexible containers is generally indicated at 14 in FIGS. 1–3. Each container receptacle 12 has a generally cylindrical, externally threaded neck shown at 16 in FIGS. 2–3, each neck 16 having a central container neck axis shown at 18 in FIGS. 1–3.

A pair of closure receptacles, a representative one of which is generally indicated at 20 in FIGS. 1–3, is configured to engage two closures at a time. One such closure is generally indicated at 22 in FIGS. 1–3. As is best shown in FIGS. 2 and 3, each closure receptacle 20 holds a single inverted threaded closure 22 in a position adjacent and below the container neck 16 and coaxially aligned with the container neck axis 18 of one the two containers 14 disposed in the container receptacles 12.

A container receptacle drive, generally indicated at 24 in FIGS. 1–3 and best shown in FIG. 1, is operably connected to both container receptacles 12 and is configured to simultaneously rotate both container receptacles 12 around their respective container neck axes 18. The container receptacle drive 24 rotates the container receptacles 12 in such a way as to rotate containers 14 engaged within the receptacles 12. Rotation of the containers 14 causes the container necks 16 to threadedly engage and seal the closures 22 onto the container necks 16.

A source of pressurized gas, diagrammatically shown at 26 in FIGS. 2 and 3, is supported in a position remote from the capping apparatus 10 and is configured to fluidly communicate with an interior 28 of the flexible containers 14 held in the container receptacles 12. Pressurized gas from the source of pressurized gas inflates and causes the flexible containers 14 to harden so as to support positive engagement with the container receptacle 12. In this hardened state, the flexible containers 14 also resist deformation under torque loads applied by the drive 24 through the container receptacles 12.

The capping apparatus 10 is configured to join hollow flexible containers 14, supplied in an inverted, i.e., neck down orientation, to threaded closures 22 disposed below the flexible containers 14—also in an inverted orientation. In an inverted orientation, the threaded closures 22 each present a threaded opening 30 upward as shown in FIGS. 2 and 3. The inverted orientation of the containers and closures 22 allows the containers 14 to be filled through upwardly extending base ends 32 of the containers 14 after the base ends 32 are severed at a subsequent tail trimming station (not shown).

Both container receptacles 12 are driven by a single belt 34 as shown in FIG. 1. Each container receptacle 12 is laterally supported within a collar generally indicated at 36 in FIGS. 1–3. Bearings, shown at 38 in FIGS. 2 and 3, are disposed between each container receptacle 12 and its corresponding collar 36 to reduce friction between the receptacles 12 and collars 36 when the container receptacles 12 are rotating within the collars 36.

Each container receptacle 12 includes a container receptacle detent shown at 40 in FIGS. 2 and 3. Each container receptacle detent 40 is configured to engage a complementary container detent formed in the flexible container 14 and shown at 42 in FIGS. 2 and 3. The detents 40, 42 engage each other when the flexible containers 14 are seated in the container receptacles 12.

The container receptacle detent 40 of each container receptacle 12 comprises a male step notch 44 configured to complement and engage a female step notch 46 formed in the base 32 of each container 14. As best shown in FIGS. 2 and 3, the male step notch 44 of each container receptacle 12 integrally extends from its respective container receptacle 12. Each male step notch 44 includes a ramped back surface 48 and a perpendicular front surface 50. At least a portion of the perpendicular front surface 50 faces in the direction that the container receptacle 12 rotates. As is also best shown in FIGS. 2 and 3, the female step notch 46 formed into each container base 32 includes ramped and perpendicular surfaces 52, 54 that complement the ramped and perpendicular surfaces of the male step notch 44 in each container receptacle 12. The engagement between the male and female step notches 44, 46 at their respective perpendicular surfaces 50, 54 allows the container receptacles 12 to positively transmit rotational movement to the containers 14 seated within them.

Each container receptacle 12 also includes a generally cylindrical drive sleeve shown at 56 in FIGS. 1–3. The drive sleeves 56 are each configured to receive the base end 32 of one of the flexible containers 14 into engagement. The drive sleeves 56 are shaped to complement the exterior dimensions of the flexible containers 14 when the flexible containers 14 are at least partially inflated. The male step notches 44 are formed on circular inner end walls 58 of the drive sleeves 56.

Each container receptacle 12 includes a hollow needle shown at 60 in FIGS. 2 and 3. The hollow needles 60 are configured to pierce the base ends of the flexible containers 14. The hollow needles 60 are fluidly communicable with the source of pressurized gas 26 as is best shown in FIG. 3. The flow of pressurized gas from the source of pressurized gas 26 to the needle 60 is controlled by a first valve 62 disposed between the needle 60 and the source of pressurized gas 26. The first valve 62 opens and closes in response to electrical inputs from an electronic air supply controller 64. The controller 64 is programmed to sequence pressurized gas supply with capping apparatus 10 operation as is described in greater detail below.

Each needle 60 is embedded in a generally cylindrical piston generally indicated at 66 in FIGS. 2 and 3. Each piston 66 is supported for reciprocal movement in a cylinder formed in each container receptacle 12 as is generally indicated at 68 in FIGS. 2 and 3. The cylinder 68 in each container receptacle 12 is disposed adjacent the drive sleeve 56, a lower end of the cylinder 68 opening into the drive sleeve 56. Each needle 60 is embedded in a lower end of an axial through bore 70 running through the axial length of each piston 66. The needle 60 and piston 66 of each container receptacle 12 are movable between a retracted position shown in FIG. 2 and a protracted position shown in FIG. 3. In each container receptacle 12, the needle 60 protrudes into the drive sleeve 56 in the protracted position.

Each piston 66 includes a wider middle section, shown at 72 in FIGS. 2 and 3, and integrally extending upper and lower end sections, shown at 74 and 76, respectively. The middle section 72 of each piston 66 includes a pair of axially spaced circumferential grooves shown at 78 in FIGS. 2 and 3. In each piston 66 an O-ring seal 80 is disposed in each of the two grooves 78 to allow the middle section 72 to slidably and sealingly engage an inner wall 82 of a correspondingly wider middle chamber portion 84 of the cylinder 68 housing the piston. The lower end section 76 of each piston 66 is slidably disposed within a correspondingly narrower lower chamber 86 of the cylinder 68 housing the piston 66. The lower chamber 86 of each cylinder 68 includes an inner circumferential groove 88 housing an O-ring seal 90. In each cylinder 68 the seal 90 engages an outer surface of the lower end section 76 of the piston 66 and an inner wall of the lower chamber 86 of the cylinder 68 to prevent pressurized air from escaping the cylinder 68.

In the protracted position shown in FIG. 3, the lower end section 76 of each piston 66 extends the full length of the lower chamber 86 of the cylinder 68 housing the piston 66. A leading surface 92 of the lower end section 76 of the piston 66 is then disposed flush with the inner end wall 58 of the drive sleeve 56. In the protracted position the needles 60 protrude from the respective leading surfaces 92 of the lower end sections 76 of the pistons 66 and will therefore pass through the bases 32 of any flexible containers 14 seated within the drive sleeves 56.

In the retracted position shown in FIG. 2, the upper end section 74 of each piston 66 is housed within an upper chamber 94 of the cylinder 68 housing the piston 66. The upper chambers 94 of the cylinders 68 are disposed in separate upper cylindrical sections 96 of the container receptacles 12. The upper cylindrical sections 96 are integrally attached to lower cylindrical sections 98 of the container receptacles 12 to form a single cylindrical member for each container receptacle 12. The drive sleeves 56 are bolted to circumferential flanges 100 that extend radially outward from a lower end of the lower cylindrical section 98 of each container receptacle 12.

Each container receptacle 12 also includes portions of two gas channels shown at 102 and 104, respectively, in FIGS. 2 and 3. The gas channels 102, 104 for each container receptacle 12 lead from a common source of pressurized gas 26 to the cylinders 68 in each container receptacle 12. In each container receptacle 12, an upper one of the gas channels 102 opens into an upper chamber 94 of the cylinder 68 at an upper end of the cylinder 68 opposite the drive sleeves 56 and above the pistons 66. A lower one of the gas channels 104 opens into the lower chamber 86 of the cylinder 68 at a lower end of the cylinder 68 adjacent the drive sleeve 56, above the lower cylinder O-ring seal 90 and below the piston 66. The upper gas channel 102 in each container receptacle 12 includes a through bore shown at 104 in FIGS. 2 and 3. Each through bore 104 extends radially inward to the upper chamber 94 of the cylinder 68 of one of the container receptacles 12 from an upper circumferential groove 106 formed into and around an outer surface of the upper cylindrical section 96 of that container receptacle 12. In each container receptacle 12, the lower gas channel 104 extends along three intersecting bores 106 from the lower chamber 86 of the cylinder 68 to a lower circumferential groove 108 formed into and around an outer surface of the lower cylindrical section 98 of the container receptacle 12.

As is diagrammatically shown in FIGS. 2 and 3, the first valve 62 is disposed in the upper gas channel 102 between the source of pressurized gas 26 and the container receptacles 12. The first valve 62 alternately admits and blocks the supply of pressurized gas to both the needle 60 and to the upper cylinder chamber 94 of each container receptacle 12. A second valve shown at 110 in FIGS. 2 and 3 and disposed in the lower gas channel 104, also opens and closes in response to electrical inputs from the electronic air supply controller 64. The second valve 110 alternately admits and blocks the supply of pressurized gas to the lower cylinder chamber 86 of each container receptacle 12.

The air supply controller 64 alternately opens and closes the two control valves 62, 110 to alternately direct pressurized gas through the respective upper and lower gas channels 102, 104 of both container receptacles 12, thus driving the pistons 66 and needles 60 downward and upward, respectively. The controller 64 is programmed to open the first valve 62 to the upper gas channels 102 before the two container receptacles 12 are rotated to thread a pair of flexible containers 14 into a pair of closures 22. The controller 64 is also programmed to close the first valve 62 and open the second valve 110 after the flexible containers 14 have been threaded completely into the closures 22.

The source of pressurized gas 26 is supported in a fixed location remote from the rotatably mounted container receptacles 12. Therefore, to move pressurized gas from the source of pressurized gas 26 into the rotating cylinders 68, the upper and lower cylindrical sections 96, 98 of each container receptacle 12 are surrounded by a stationary collar 36. The cylindrical sections 96, 98 and collars 36 forming rotary unions 96, 98, 36 configured to supply pressurized gas 26 from the source of pressurized gas 26 to the upper and lower gas channels 102, 104 of the container receptacles 12 while the container receptacles 12 are rotating within their respective collars 36.

As shown in FIGS. 2 and 3, the collars 36 each include a pair of axially spaced through-bores 112 and concentric threaded counter bores 114. A male threaded fitting is threadedly engaged in each of the four threaded counter bores 114, each attaching one of four pneumatic hoses (two of which are shown at 116 and 118 in FIGS. 1–3) to the collars 36. The axially spaced through-bores 112 are positioned on each collar 36 to align with the upper and lower outer circumferential grooves 106, 108 in the cylindrical sections 96, 98 of each container receptacle 12. The through bores 112 and grooves 106, 108 define portions of the upper and lower gas channels 102, 104.

Four O-ring seals 120 are seated in four respective circumferential grooves 122 in each collar. Two of the seals 120 are disposed between each collar 36 and the upper cylindrical section 96 of its respective container receptacle 12 and are disposed above and below the upper circumferential groove 106, respectively. Likewise, the two remaining seals 120 and grooves 122 are disposed between the collar 36 and the lower cylindrical section 98 of the container receptacle 12 and above and below the lower circumferential groove 108, respectively. The O-ring seals prevent pressurized air from escaping the gas channels 102, 104.

The two container receptacles 12 are mounted above an outer edge 136 of a star wheel shown at 138 in FIGS. 1–3. The star wheel 138 is supported on a rotatably mounted, intermittently driven, i.e., "indexed", turret (not shown). The container receptacles 12 are mounted on and suspended from a stationary, radially-extending arm 126 and are driven by the belt 34. The belt 34 extends from an outer drive pulley shown at 128 in FIG. 1 and passes around two inner pulleys, one of which is shown at 130 in FIG. 1. The inner pulleys 130 are each fixed to respective upper ends of two vertical drive shafts, one of which is shown at 132 in FIG. 1. The vertical drive shafts are coaxially aligned with the two container receptacles 12 and are connected to the respective container receptacles 12 through respective torque limiters, one of which is shown at 134 in FIG. 1. The torque limiters 134 help to prevent twisting and buckling of the flexible containers 14 held in the container receptacles 12 and prevent over-tightening of the closures 22 by limiting the amount of torque that the drive 24 can apply to the flexible containers 14.

The star wheel 138 includes a plurality of container support brackets, shown at 146 in FIG. 1, that each support two containers 14 at a time in a vertical, inverted orientation during the capping operation. The container support brackets continue to hold the flexible containers 14 in this position after the containers 14 have been threaded into respective closures 22 and through subsequent tail cutting, filling and sealing operations.

The closure receptacle 20 is configured to support two closures 22 at a time against rotation in coaxial alignment below containers 14 supported in the container receptacles 12. The closure receptacle 20 comprises a plurality of semi-circular recesses 140 formed into an outer circumferential edge 136 of the star wheel 138. The closure receptacle 20 further comprises a single pair of opposing semi-circular recesses, one of which is shown in cross-section at 142 in FIGS. 1–3. The pair of opposing recesses 142 are formed in a reciprocally mounted, non-indexed, non-rotating cylinder-driven clamp 144 mounted adjacent and radially spaced from the star wheel 138 and defining the location of a capping station 152 adjacent the star wheel outer edge 136. The star wheel 138 and clamp recesses 140, 142 are configured to releasably secure two closures 22 at a time against rotational movement at the capping station 152 after the closures 22 are fed into the capping apparatus 10 by a conveyor feed system (not shown) or are rotationally advanced to the capping station 152 by the star wheel 138 from a previous work station.

A suitable capping apparatus construction, including a drive, a torque limiter, a star wheel and closure receptacles, but not including the gas inflation system and drive sleeve configuration of the present invention, is disclosed in detail in U.S. Pat No. 5,621,960 which we incorporate by reference.

Other embodiments of the capping apparatus 10 may incorporate any one or more of a variety of variations while remaining within the scope of the invention. For example, the drive 24 may be connected to the closure receptacles 20 instead of the container receptacles 12 with the containers 14 secured against rotation and the closures 22 rotationally driven. Also, the capping apparatus 10 may be configured to join flexible containers 14 and closures 22 that are supplied in an upright, or any other suitable orientation other than inverted. In addition, any one of a number of suitable detent configurations may be employed so long as the detents are formed in such a way as to be capable of enhancing the transmission of rotational movement from container receptacles 12 to containers 14. Still further, the drive sleeve 56 may be other than cylindrical in shape to accommodate flexible containers 14 of various configurations.

In practice, the flexible containers 14 may be screwed into the threaded closures 22 or caps by first forming the flexible containers 14 to include tubular side walls, a circular base, the externally threaded tubular neck 16 and the container detent 42, i.e., female step notch 46. According to this method, the closures 22 are formed to include the internally threaded openings 30.

A capping apparatus 10 is then provided, including the two rotationally-mounted container receptacles 12, the torque limiters 134, the closure receptacle 20 and the source of pressurized air 26 described above and in U.S. Pat. No. 5,621,960. The capping apparatus 10 is installed adjacent the turret such that the container receptacles 12 are disposed above the outer edge 136 of the star wheel 138 as described above.

The source of pressurized air 26 is connected to the two container receptacles 12 in such a way as to be fluidly communicable with the needles 60 and the cylinders 68 in the container receptacles 12. The flexible containers 14 and closures 22 are then supplied, in an inverted orientation, to the turret, two at a time, by any one of a number of conveying systems known in the art. After the turret indexes each pair of containers 14 to the capping station 152, a linear motor shown at 150 in FIG. 1, lowers the two drive sleeves 56 into engagement over the bases 32 of each pair of inverted containers 14. The bases 32 of the containers 14 are positioned to allow the container receptacle detents 40 to engage the container detents 42.

At the same time that each pair of containers 14 are moved to the capping station 152, two of the closures 22 are inserted into the semi-circular star wheel recesses 140 at the capping station 152. The cylinder-driven, reciprocally-mounted clamp 144 is then moved toward the star wheel recesses 140 containing the closures 22 until the closures 22 are secured between the star wheel recesses 140 and the opposing pair of semi-circular recesses 142 in the clamp 144. The capping apparatus 10 is then operated to cause the necks 16 of the two flexible containers 14 to engage the internally threaded openings 30 in the inverted closures 22 at the capping station.

As each pair of container necks 16 are moved into engagement with a corresponding pair of closures 22 at the capping station, the controller 64 closes the second valve 110 and opens the first valve 62 allowing pressurized air to flow into the upper cylinder chamber 94 of each container receptacle 12 which drives the pistons 66 in the container receptacles 12 downward toward their respective extended positions. Because the needles 60 are mounted in the pistons 66, the needles 60 also move to their extended positions, protruding into the receptacle drive sleeves 56 of their respective container receptacles 12 and piercing the bases of the flexible containers 14 engaged within the drive sleeves 56.

Once they have been pierced, the flexible containers 14 are inflated by pressurized gas flowing from the upper cylinder chambers 94 of the respective container receptacles 12 through the hollow needles 60. The pressurized gas causes respective sidewalls 154 of the containers 14 to move outward against inner walls of their respective drive sleeves 56 as shown in FIG. 3. Although the container necks 16 have not been threaded into their respective closures 22 at this point, the container receptacles 12 hold them in engagement against the closures 22 firmly enough to provide a sufficiently air-tight seal to allow the containers 14 to be inflated.

The capping apparatus 10 is then operated to thread the necks 16 of the flexible containers 14 into the openings in the respective closures 22 by rotating the flexible containers 14 through the respective torque limiters and container receptacles 12. When the torque limiters 134 sense that the containers 14 are fully threaded into the closures 22, the torque limiters 134 will cease rotation of the closure receptacles 20.

After the capping apparatus 10 caps a container 14 and the torque limiter 134 has ceased rotation, the air supply controller 64 closes the first valve 62 and opens the second valve 110. Pressurized air then flows through the lower air channel 104 into the lower cylinder chambers 86 of the container receptacles 12 forcing the pistons 66 upward and withdrawing the needles 60 from the bases of the containers.

After the needles 60 have been withdrawn from a pair of containers 14, the linear motor 150 is operated to lift the container receptacles 12 from the upwardly extending bases of the containers 14. After the container receptacles 12 have been removed from the containers 14, the containers are advances to the tail trimming station where a portion of the base 32 of each container is then severed to provide cut openings for a subsequent filling operation. Finally, the containers 14 are advanced to an unload station. The containers may later be filled through the cut openings in their bases 32 with a product to be dispensed from the containers 14. After filling, the cut openings in the containers 14 may then sealed shut by any one of a number of suitable methods such as the method disclosed in U.S. Pat. No. 4,243,448. This patent issued Jan. 6, 1981 to Fagniart et al. and is incorporated herein by reference.

The description and drawings illustratively set forth our presently preferred invention embodiment. We intend the description and drawings to describe this embodiment and not to limit the scope of the invention. Obviously, it is possible to modify this embodiment while remaining within the scope of the following claims. Therefore, within the scope of the claims, one may practice the invention otherwise than as the description and drawings specifically show and describe.

We claim:

1. A method for joining a flexible container to a threaded closure, the method including the steps of:

providing a flexible container having a base and a threaded neck;

providing a closure configured to sealingly engage the threaded neck;

providing a capping apparatus including a container receptacle configured to engage the flexible container;

engaging the flexible container with the container receptacle;

operating the capping apparatus to cause the neck of the flexible container to engage a threaded opening in the closure;

inflating the flexible container by providing pressurized gas within the flexible container;

operating the capping apparatus to thread the neck of the flexible container into the opening in the closure while the flexible container is inflated by causing relative rotation between the flexible container and the closure.

2. A method as set forth in claim 1 in which:

the step of providing a capping apparatus includes the step of rotationally mounting the container receptacle; and the step of operating the capping apparatus to thread the neck of the flexible container into the opening in the closure includes the additional steps of:

securing the closure against rotation; and rotating the flexible container.

3. A method as set forth in claim 2 in which the step of engaging the flexible container with the container receptacle includes the step of disposing a drive sleeve of the container receptacle over a portion of the flexible container.

4. A method as set forth in claim 3 in which:

the step of providing a flexible container includes the step of forming a container detent in the container;

the step of providing a capping apparatus includes the step of forming a container receptacle detent in the drive sleeve of the container receptacle; and the step of disposing the drive sleeve over a portion of the flexible container includes the step of causing the container receptacle detent to engage the container detent.

5. A method as set forth in claim 3 in which:

the step of providing a capping apparatus includes the step of providing a hollow needle in the container receptacle;

the step of providing a source of pressurized gas includes the step of providing fluid communication between the source of pressurized gas and the needle; and the step of operating the capping apparatus to cause the container receptacle to engage the flexible container includes the steps of:

disposing the drive sleeve over a portion of the flexible container;

causing the needle to extend into the drive sleeve and pierce the flexible container; and causing a sidewall of the container to move outward against the drive sleeve by injecting pressurized gas into the flexible container through the hollow needle.

6. A method as set forth in claim 5 in which:

the step of providing a capping apparatus includes the step of providing a piston in a cylinder within the container receptacle with the needle being supported in and extending from the piston; and the step of causing the needle to pierce the container includes the step of causing the piston to move toward the container by providing pressurized gas in the cylinder on a side of the piston opposite the container.

7. A method as set forth in claim 1 in which:

the step of providing a capping apparatus includes the step of providing a container receptacle oriented to receive a base of the container into the receptacle with the container neck extending downward; and the step of providing a closure includes the step of providing the closure in an inverted orientation below the downwardly extending neck of the flexible container.

8. A method as set forth in claim 2 further including the step of providing a torque limiter configured to limit the amount of torque that the apparatus applies to the flexible container while threading the container into the closure.

9. A capping apparatus for joining a hollow flexible container and a threaded closure, the apparatus comprising:

a container receptacle configured to engage a flexible container having a threaded generally cylindrical neck, the neck having a central container neck axis;

a closure receptacle configured to engage a closure in a position adjacent the container neck and coaxially aligned with the container neck axis;

a drive operably connected to at least one of the container receptacle and the closure receptacle and operable to rotate at least one of the container receptacle and the closure receptacle around the container neck axis to threadedly engage the container neck and closure; and a source of pressurized gas to fluidly communicate with an interior of the flexible container to inflate the flexible container and cause the flexible container to positively engage the container receptacle and to resist deformation under torque loads resulting from threaded engagement of the container neck and closure, during the relative rotation and securement of the container neck and closure.

10. A capping apparatus as set forth in claim 9 in which:

the container receptacle is rotationally mounted;

the closure receptacle is configured to support a closure against rotation; and the drive is operably connected to the container receptacle and is operable to rotate the container receptacle around the container neck axis.

11. A capping apparatus as set forth in claim 10 in which the container receptacle includes a container receptacle detent configured to engage a container detent formed in the flexible container.

12. A capping apparatus as set forth in claim 11 in which the container receptacle detent comprises a male step notch configured to complement and engage a female step notch formed in a base of the container.

13. A capping apparatus as set forth in claim 12 in which the container receptacle includes a generally cylindrical drive sleeve configured to receive a base end of the flexible container, the male step notch being formed on an inner end wall of the drive sleeve.

14. A capping apparatus as set forth in claim 13 in which the container receptacle includes a hollow needle configured to pierce the flexible container, the hollow needle being fluidly communicable with the source of pressurized gas.

15. A capping apparatus as set forth in claim 14 in which the container receptacle includes a piston supported for reciprocal movement in a cylinder disposed adjacent the drive sleeve, the hollow needle being supported in the piston along a central axis of the piston, the needle and piston being movable between a retracted position and a protracted position, the needle protruding into the drive sleeve in the protracted position.

16. A capping apparatus as set forth in claim 15 in which the container receptacle includes two gas channels leading from the source of pressurized gas to the cylinder, one of the gas channels opening into an end of the cylinder opposite the drive sleeve and the other of the two gas channels opening into an end the cylinder adjacent the drive sleeve, the source of pressurized gas including at least one control valve configured to alternately direct pressurized gas through the two gas channels to drive the piston and needle downward and upward, respectively.

17. A capping apparatus as set forth in claim 16 in which:

the source of pressurized gas is supported in a fixed location remote from the rotatably mounted container receptacle; and a generally cylindrical portion of the container receptacle is surrounded by a stationary collar, the cylindrical portion and collar forming a rotary union configured to supply pressurized gas from the source of pressurized gas to the upper and lower gas channels while the container receptacle is rotating within the collar.

18. A capping apparatus as set forth in claim 9 in which the capping apparatus includes a torque limiter connected between the drive and the closure receptacle.

19. A capping apparatus as set forth in claim 9 in which the capping apparatus is configured to join a hollow flexible container in an inverted orientation to a threaded closure in an inverted orientation below the flexible container.

* * * * *